US005501447A

United States Patent [19]

Haupenthal

[11] Patent Number: 5,501,447

[45] Date of Patent: Mar. 26, 1996

[54] DEVICE FOR ADJUSTING THE POSITIONS OF SUCTION-TYPE GRIPPERS ON A SHEET-TRANSFER DRUM

[75] Inventor: Rudi Haupenthal, Epfenbach, Germany

[73] Assignee: Heidelberger Druckmaschinen AG, Heidelberg, Germany

[21] Appl. No.: 240,923

[22] Filed: May 10, 1994

[30] Foreign Application Priority Data

May 10, 1993 [DE] Germany ..... 43 15 547.2

[51] Int. Cl.[6] ..... B65H 5/12

[52] U.S. Cl. ..... 271/276; 271/196; 271/95

[58] Field of Search ..... 271/94–96, 196, 271/197, 276

[56] References Cited

U.S. PATENT DOCUMENTS 3,599,541 8/1971 Allen ..... 271/95

5,037,079 8/1991 Siegel et al. ..... 271/276

5,060,931 10/1991 Morita ..... 271/196

FOREIGN PATENT DOCUMENTS 1139851 11/1962 Germany ..... 271/95

730100 5/1955 United Kingdom ..... 271/94

*Primary Examiner*—H. Grant Skaggs

*Attorney, Agent, or Firm*—Herbert L. Lerner; Laurence A. Greenberg

[57] ABSTRACT

A device for adjusting the position of suction-type grippers on a sheet-transfer drum, wherein the suction-type grippers are disposed basically along at least one generating line, are displaceable perpendicularly to a sheet-transport direction and are fixable, including a plurality of endless belts, the suction-type grippers being disposed on the endless belts.

6 Claims, 2 Drawing Sheets

DEVICE FOR ADJUSTING THE POSITIONS OF SUCTION-TYPE GRIPPERS ON A SHEET-TRANSFER DRUM

SPECIFICATION

The invention is usable in sheet-fed rotary printing presses wherein sheet-transfer drums are provided for conveying sheets, the respective sheets being held in grippers on the sheet-transfer drums, and at least some of the grippers being formed as suction-type grippers.

Whenever there is a job change in order to print sheets of a different format or size, it is advantageous to adjust the position of the suction-type grippers on the outer cylindrical surface of the sheet-transfer drum to suit the new format or size to be printed. For this purpose, devices for adjusting the positions of suction-type grippers are used which permit an individual or group-wise adjustment of the suction-type grippers in the rotational direction of the respective sheet and perpendicularly to the rotational direction of the respective sheet. Simultaneously with the adjustment of the position of the suction-type grippers, it is possible for the sheet-supporting surface on the outer cylindrical surface to be adjusted to suit the new sheet size or format to be printed.

Heretofore known devices achieve an adjustment to a new sheet size or format by adjusting the suction-type grippers, in accordance with the sheet length, a defined angle about the rotational axis of the sheet-transfer drum, and by rendering inoperative the suction-type grippers lying outside or beyond the new sheet width in the direction perpendicular to the sheet-transport direction. Thus, the position of the suction-type grippers in the direction perpendicular to the sheet-transport direction is maintained, the suction air being removed only from those suction-type grippers which are not needed or being used (Japanese Patents 4-161336, 4-153039 and 4-158041).

A disadvantage thereof is that not all suction-type grippers provided transversely to the sheet-transport direction are used for holding small-format sheets, and that a special device must be provided for shutting off the non-required suction-type grippers, due to which, such devices for adjusting the position of the suction-type grippers on a sheet-transfer drum are material-intensive and cost intensive and do not provide a maximum possible holding force.

In relatively simple constructions, it is possible to set the suction-type grippers manually to a new sheet size or format transversely to the sheet-transport direction. For this purpose, the suction-type grippers may be fixed in a straight or rectilinear guide by means of a clamping screw. In order to adjust the suction-type grippers, the clamping screws of the suction-type grippers are individually loosened and the suction-type grippers are displaced, preferably along a scale, to a new position within the straight or rectilinear guide.

The suction-type grippers are re-clamped in the new position. The suction-type grippers are connected to a suction-air source through the intermediary of flexible tubes and a rotary lead-through or lead-in.

Such constructions have the disadvantage that the changeover of the suction-type grippers to a new sheet size or format is time-consuming, the sheet-transfer drums usually being surrounded by further machine elements or components of the printing press, so that access to the clamping screws for manual adjustment is rendered more difficult. For example, a double-size sheet-transfer drum, i.e., a transfer drum having twice the diameter of an impression cylinder or blanket cylinder, for example, if the press has two rows of suction-type grippers, which, for changeover, must be rotated further through at least 180°. Furthermore, the risk exists that, due to setting errors, the suction-type grippers will be set differently on the two halves of the sheet-transfer drum.

A further disadvantage is that the adjustment travel of the suction-type grippers is limited by the tube or hose connection, which requires the tube for hose having to be laid in a large arc because, otherwise, there would be a danger, particularly in the case of smaller sheet sizes or formats and small bending radii, that the tube or hose might become constricted or contracted by the vacuum generated by the suction-air source.

It is accordingly an object of the invention to provide a device for adjusting the position of suction-type grippers, on a sheet transfer drum which permits a rapid, less material-intensive adjustment of the suction-type grippers transversely to the sheet-transport direction than has been possible heretofore, all of suction-type grippers being disposed across the width of the sheet-transfer drum being usable for firmly holding the sheets for each sheet size or format.

With the foregoing and other objects in view, thus is provided, in accordance with the invention, a device for adjusting the position of suction-type grippers on a sheet-transfer drum, wherein the suction-type grippers are disposed basically along at least one generating line, are displaceable perpendicularly to a sheet-transport direction and are fixable, comprising a plurality of endless belts, the suction-type grippers being disposed on the endless belts.

Thus, in order to displace the suction-type grippers in the direction perpendicular to the sheet-transport direction, the suction-type grippers are disposed on endless belts. A high degree of flexibility is achieved in that precisely one belt is provided for each suction-type gripper. The sides of the belts lie parallel to the rotational axis of the sheet-transfer drum. In addition to a possible tube connection, the suction-type grippers or holders thereof may be guided on a rigid, hollow suction box connected to a suction-air source.

In accordance with another feature of the invention, each of the endless belts is provided for each of the suction-type gripper, and including respective coaxially disposed deflection elements about which each of the endless belts is looped, the deflection elements being disposed parallel to the rotational axis of the sheet-transfer drum.

In accordance with a further feature of the invention, one of the endless belts is provided for each of the suction-type grippers, the endless belts being disposed parallel to one another, a rigid, hollow suction box disposed between sides of the endless belts, all of the suction-type grippers being guidable on the suction box, the endless belts being tightly displaceable around the suction box, the suction box being formed with elongated slots in a displacement region of each of the suction-type grippers and being connectable to a suction-air source, the respective suction-type gripper being formed with an intake opening, a holder for the respective suction-type gripper, a connection hole formed at a connection location of the holder for the respective suction-type gripper in the endless belt, the connection hole forming a connection between the intake opening of the respective suction-type gripper and the suction-air source.

Thus, the suction box may advantageously be disposed between the sides of the belts, so that the belts tightly enclose the suction box in one plane.

In accordance with an added feature of the invention, the endless belts are displaceable independently of one another.

In accordance with an additional feature of the invention, the deflection elements of the endless belts are, respectively, connected to separate driving elements, and including a control device connected to the driving.

In order to route the suction air from the suction-air source via the suction box to the suction-type gripper, which is seated on a holder, the suction box is formed with continuous elongated slots in the one plane over the displacement region of the suction-type gripper, and the respective belt is formed with a connection hole. The belts form a seal between the suction box fixedly disposed on the sheet-transfer drum and the holder for the suction-type gripper, the holder being connected to the belt. The suction-type grippers are displaceable manually together with the belt when the suction air is turned off. Remote adjustment of the suction-type grippers may be achieved in that the deflection elements of the belts are each connected to a separate driving element, which is connectable to a central printing-press control. The suction-type grippers are fixed in position by application of the suction air, due to which the belts are pressed against the surface of the suction box in the region of the elongated slots. One or more such devices according to the invention may be provided across the width of the sheet along a sheet edge and in accordance with to the number of sheets to be transported on the sheet-transfer drum.

In accordance with a concomitant feature of the invention, the device includes a plurality of hollow suction elements, respectively, having a square profile section and formed with two side surfaces, the endless belts, respectively, in contact with the side surfaces of pairs of the hollow suction elements of square profile section, the suction elements being disposed in the displacement direction and being formed as guides for the holders of the suction-type grippers, a holder for the respective suction-type gripper, the endless belts, respectively, being formed with a connection hole at a connection location with the respective holder, the connection hole communicating with elongated slots formed pairwise in the side surfaces of the suction elements, hollow spaces in the hollow suction elements being connectable to a suction-air source.

Thus, in another embodiment of the invention, the belts may be in contact with the side faces of two parallel-disposed, hollow suction elements or bodies, the suction elements having a square cross-sectional profile. The suction elements serve as guides for four holders for four suction-type grippers disposed in one half of the width of the sheet-transfer drum. For the supply of the suction air, the side surfaces of the suction elements are formed of pairs of elongated slots, and the belts are formed with connection holes at a connection location with the holders, the hollow spaces of the suction elements being connected to a suction-air source. This ensures that, in the same overall space, another suction-type gripper is connectable.

Other features which are considered as characteristic for the invention are set forth in the appended claims.

Although the invention is illustrated and described herein as embodied in a device for adjusting the position of suction-type grippers on a sheet-transfer drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
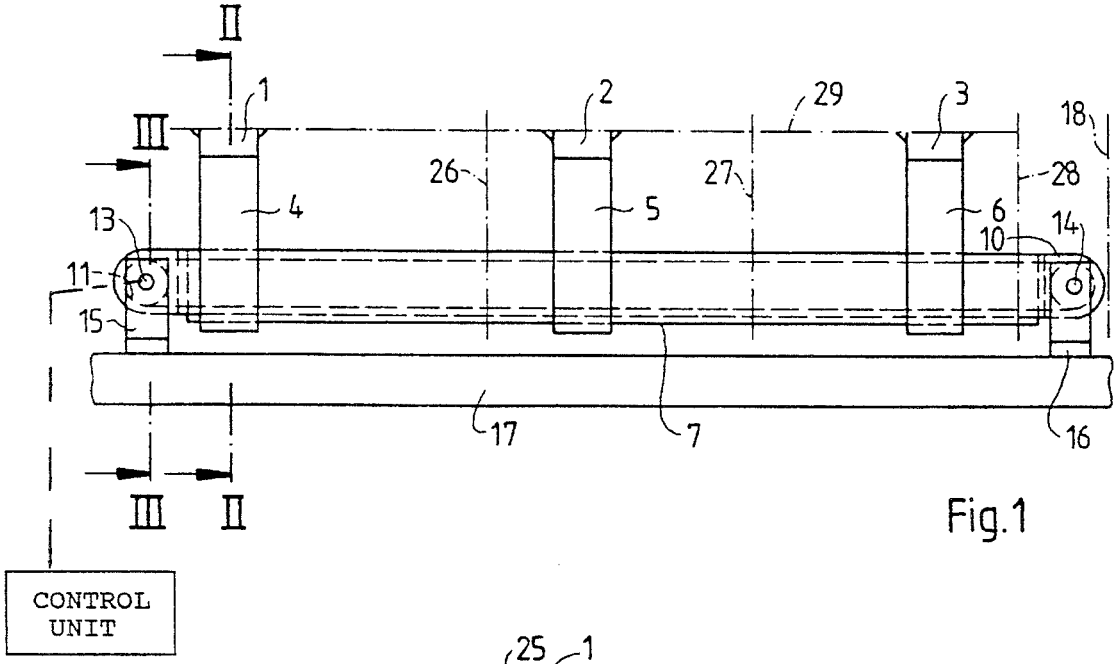
FIG. 1 is a diagrammatic front elevational view of the device for adjusting the position of three suction-type grippers in a sheet transfer drum, in accordance with the invention.

Referring now to the drawings and, first, particularly to FIG. 1 thereof, there is shown therein, a device according to the invention, two of which are provided across the width of a sheet, so that a total of six suction-type grippers altogether can be positioned along a sheet edge. The device according to the invention includes, over half of the width of a sheet, three suction-type grippers 1, 2 and 3, which are fastened to holders 4, 5 and 6, respectively. The holders 4, 5 and 6, respectively, encircle a suction box 7, which is fixedly installed on a sheet-transfer drum and serves as a straight or rectilinear guide for the holders 4, 5 and 6.

The holders 4, 5 and 6 are attached to respective belts 8, 9 and 10, which, with the sides or parallel opposite strands thereof, loop around two opposite surfaces of the suction box 7. The belts 8, 9 and 10 extend around deflection rollers 11, which are supported coaxially on shafts 13 and 14 by means of bushings 12. The shafts 13 and 14 are supported in bearing blocks 15 and 16, respectively, which are fastened to a cross-member or traverse 17, which is disposed parallel to the axis of the sheet-transfer drum. The bearing block 16 with the shaft 14 is disposed close to the central plane 18 of the sheet-transfer drum.

In the side surface of the suction box 7 facing the suction-type grippers 1, 2 and 3, the suction box 7 is formed with longitudinal slots 19, 20 and 21, respectively, over the displacement region of the respective suction-type grippers 1, 2 and 3. A connection hole 22 is provided in the belt 8 at the connection locations of the holders 4, 5 and 6 to the belts 8, 9 and 10, respectively. The suction box 7, the interior of which is hollow, may be connected to a suction-air source through the intermediary of a rotary lead-through, so that a connection can be established between the suction-air source and the intake openings 25 of the suction-type grippers 1, 2 and 3 through the intermediary of the longitudinal slots 19, 20 and 21, the connection holes 22 and holes 23 and 24 provided in the holders 4, 5 and 6.

The suction-air supply is interrupted when the suction-type grippers are being adjusted. Adjustment may be performed manually or by means of motors if the deflection rollers 11 of the belts 8, 9 and 10 are each connected to a separate drive. The suction-type grippers 1, 2 and 3 are fixed in the new positions 26, 27 and 28 thereof by the fact that the belts 8, 9 and 10, respectively, are sucked onto the upper seating surface of the suction box 7, formed with the elongated slots 19, 20 and 21, due to the vacuum generated by the suction-air source. With the suction air applied, a sheet can be held in the plane 29 of the outer cylindrical surface of the sheet-transfer drum.

Figure 2:
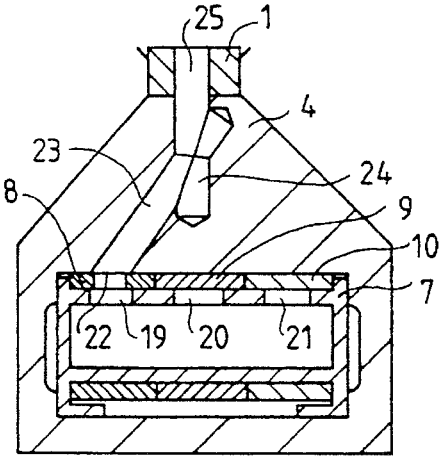
FIG. 2 is a cross-sectional view of FIG. 1 taken along line II—II, in the direction of the arrows.
Figure 3:
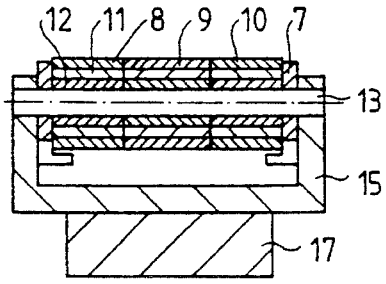
FIG. 3 is a cross-sectional view of FIG. 1 taken along line III—III, in the direction of the arrows.
Figure 4:
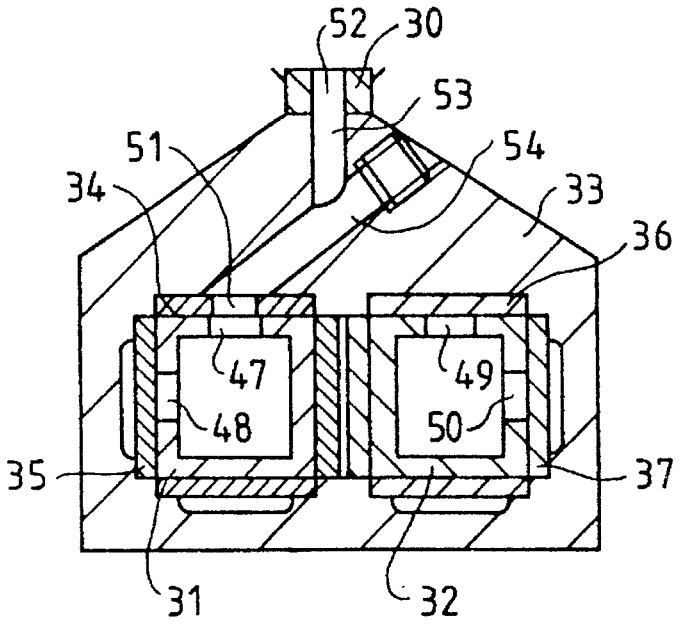
FIG. 4 is a cross-sectional view of another embodiment of the adjusting device for four suction-type grippers on one half of the sheet-transfer drum.
Figure 5:
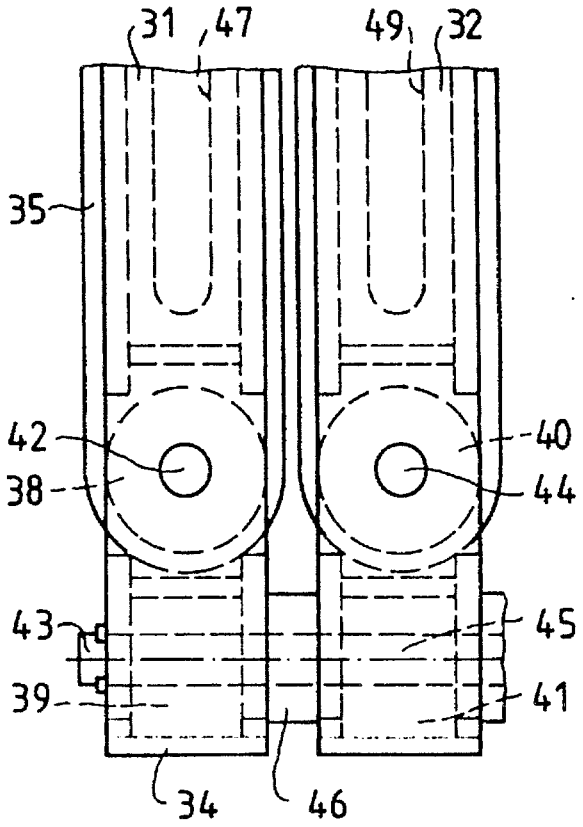
FIG. 5 is a fragmentary diagrammatic front elevational view of FIG. 4 showing the arrangement of deflection elements thereof.

In the other embodiment of the invention shown in FIGS. 4 and 5, four suction-type grippers 30, only one of which is illustrated, are provided on one half of the sheet-transfer drum, each having two hollow suction bodies 31 and 32 of square cross section, the suction bodies 31 and 32 being disposed parallel to one another in the displacement direction of the suction-type grippers 30. The suction bodies 31 and 32 serve as guides for the holders 33 of the suction-type grippers 30, respectively connected to a belt 34, 35, 36 and 37. The belts 34, 35, 36 and 37 are in contact pairwise with side surfaces of the suction bodies 31 and 32 and are disposed over or looped around deflection rollers 38, 39, 40 and 41, as shown in FIG. 5, the shafts 42, 43, 44 and 45 of the respective deflection rollers 38, 39, 40 and 41 being perpendicular to one another in pairwise. The shafts 43 and 45 of the deflection rollers 39 and 41, respectively, are coaxial with one another, the deflection rollers 39 and 41 being held apart by a spacer 46. For each belt 34, 35, 36 and 37, a longitudinal slot 47, 48, 49 and 50, respectively, is provided in one of the side faces of the respective suction body 31 and 32 over the displacement region of the respective suction-type gripper 30. At a connection location to a holder 33, each belt 34, 35, 36 and 37 has a connection hole 51, which forms a connection between an intake opening 52, overflow channels 53 and 54, hollow spaces of the suction bodies 31 and 32 and a suction-air source connected to the suction bodies 31 and 32. The holders 33 and the suction-type grippers 30 are displaced and fixed in a manner similar to the manner described hereinbefore with reference to FIGS. 1 to 3.

I claim:

1. Device for adjusting the position of suction-type grippers on a sheet-transfer drum, wherein the suction-type grippers are disposed basically along at least one generating line, are displaceable and fixable perpendicularly to a sheet-transport direction, comprising a plurality of endless belts, the suction-type grippers being disposed on the endless belts.

2. Device according to claim 1, wherein each of said endless belts is provided for each of the suction-type gripper, and including respective coaxially disposed deflection elements about which each of said endless belts is looped said deflection elements being disposed parallel to the rotational axis of the sheet-transfer drum.

3. Device according to claim 2, wherein said deflection elements of said endless belts are, respectively, connected to separate driving elements, and including a control device connected to said driving elements.

4. Device according to claim 1, wherein one of said endless belts is provided for each of the suction-type grippers, the endless belts being disposed parallel to one another, a rigid, hollow suction box disposed between sides of the endless belts, all of the suction-type grippers being guidable on said suction box, said endless belts being tightly displaceable around said suction box, said suction box being formed with elongated slots in a displacement region of each of the suction-type grippers and being connectable to a suction-air source, the respective suction-type gripper being formed with an intake opening, a holder for the respective suction-type gripper, a connection hole formed at a connection location of said holder for the respective suction-type gripper in said endless belt, said connection hole forming a connection between said intake opening of the respective suction-type gripper and the suction-air source.

5. Device according to claim 1, wherein the endless belts are displaceable independently of one another.

6. Device according to claim 1, including a plurality of hollow suction elements, respectively, having a square profile section and formed with two side surfaces, the endless belts, respectively, in contact with said side surfaces of pairs of said hollow suction elements of square profile section, said suction elements being disposed in the displacement direction and being formed as guides for the holders of the suction-type grippers, a holder for the respective suction-type gripper, the endless belts, respectively, being formed with a connection hole at a connection location with the respective holder, said connection hole communicating with elongated slots formed pairwise in the side surfaces of the suction elements, hollow spaces in said hollow suction elements being connectable to a suction-air source.

* * * * *